US009275612B2

(12) United States Patent
Suenaga et al.

(10) Patent No.: US 9,275,612 B2
(45) Date of Patent: Mar. 1, 2016

(54) KEYBOARD INSTRUMENT

(71) Applicant: YAMAHA CORPORATION, Hamamatsu-shi, Shizuoka-ken (JP)

(72) Inventors: Tsukasa Suenaga, Hamamatsu (JP); Akira Miki, Hamamatsu (JP); Hirofumi Onitsuka, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 14/589,241

(22) Filed: Jan. 5, 2015

(65) Prior Publication Data

US 2015/0194138 A1 Jul. 9, 2015

(30) Foreign Application Priority Data

Jan. 9, 2014 (JP) ..... 2014-002355

(51) Int. Cl.

| | |
|---|---|
| ***G10H 1/32*** | (2006.01) |
| ***G10C 3/12*** | (2006.01) |
| ***H04R 1/28*** | (2006.01) |
| ***H04R 1/34*** | (2006.01) |

(52) U.S. Cl.

CPC .. *G10C 3/12* (2013.01); *G10H 1/32* (2013.01); *H04R 1/2823* (2013.01); *H04R 1/2861* (2013.01); *H04R 1/345* (2013.01); *H04R 2205/022* (2013.01)

(58) Field of Classification Search

USPC ..... 84/644
IPC ..... G10H 1/32
See application file for complete search history.

(56) References Cited

U.S. PATENT DOCUMENTS

| | | | | |
|---|---|---|---|---|
| 2,286,742 | A * | 6/1942 | Kellogg | 84/600 |
| 3,410,947 | A * | 11/1968 | Behnke et al. | 84/600 |
| 4,464,967 | A * | 8/1984 | Trimborn | 84/743 |
| 5,056,400 | A * | 10/1991 | Wachi et al. | 84/600 |
| 8,193,438 | B2 * | 6/2012 | Hoshino | 84/644 |
| 8,822,804 | B1 * | 9/2014 | Vassilev | 84/723 |
| 2004/0173086 | A1 * | 9/2004 | Sato et al. | 84/745 |
| 2005/0150368 | A1 | 7/2005 | Izumi et al. | |
| 2007/0199427 | A1 * | 8/2007 | Suzuki et al. | 84/330 |
| 2008/0072747 | A1 * | 3/2008 | Nishida | 84/744 |
| 2012/0222541 | A1 * | 9/2012 | Ishimura et al. | 84/744 |
| 2013/0283998 | A1 | 10/2013 | Irimura | |
| 2013/0305899 | A1 | 11/2013 | Nagatsuma et al. | |
| 2014/0013929 | A1 * | 1/2014 | El-Khadem et al. | 84/726 |

FOREIGN PATENT DOCUMENTS

| | | | |
|---|---|---|---|
| JP | 2000338975 | A | 12/2000 |
| JP | 2008185763 | A | 8/2008 |
| JP | 5161463 | B2 | 3/2013 |

OTHER PUBLICATIONS

European Search Report issued in counterpart European application No. EP15150437.0, dated May 29, 2015.

* cited by examiner

*Primary Examiner* — David Warren
(74) *Attorney, Agent, or Firm* — Rossi, Kimms & McDowell LLP

(57) ABSTRACT

A keyboard instrument includes: an instrument body; at least one speaker; and at least one acoustic pipe configured to collect a sound emitted from the at least one speaker and guide the sound to at least one sound emitting opening formed in a front face of the instrument body.

13 Claims, 6 Drawing Sheets

KEYBOARD INSTRUMENT

CROSS REFERENCE TO RELATED APPLICATION

The present application claims priority from Japanese Patent Application No. 2014-002355, which was filed on Jan. 9, 2014, the disclosure of which is herein incorporated by reference in its entirety.

BACKGROUND

1. Technical Field

The present invention relates to a keyboard instrument, such as an electronic piano, including a keyboard and a speaker for reproducing a sound based on pressing on a key of the keyboard.

2. Description of the Related Art

Patent Document 1 (Japanese Patent No. 5161463) discloses an electronic piano as a conventional keyboard instrument, for example. In this electronic piano, two speakers are mounted on a keybed provided in a bottom portion of a body casing in a state in which sound emitting faces of the respective speakers face downward.

In this electronic piano, sounds reproduced by the speakers based on pressing on a key of the keyboard are emitted downward from the sound emitting faces of the respective speakers, then reflected from a floor, and delivered to a player's ear, and on the other hand, sounds emitted from back faces of the respective speakers leak out from clearances formed in a front face of the body casing, via a plurality of bent passages formed in the body casing.

SUMMARY

In the conventional electronic piano, incidentally, the sounds emitted downward from the sound emitting faces of the respective speakers are reflected from the floor as described above. This reflection delays the sounds and deteriorates high frequency components thereof. Thus, the sounds delivered to the player's ear have a slow attack, and a location of an acoustic image of the sounds is far from the keyboard. On the other hand, the sounds emitted from the back faces of the respective speakers disperse in the body casing, and a part of the sounds is emitted from the clearances formed in the front face of the body casing via the plurality of bent passages. Thus, the sounds are emitted at low volume from the clearances formed in the front face of the body casing. Also, since the sounds emitted from the clearances formed in the front face of the body casing have passed through the plurality of bent passages, a location of an acoustic image of the sounds is unclear, making the sounds vague. Accordingly, even if the sounds emitted from the clearances formed in the front face of the body casing reaches the player's ear, the player cannot hear sounds whose acoustic image is localized near the keyboard. Thus, it is difficult for the conventional electronic piano to deliver high-quality sounds whose acoustic image is localized near the keyboard, to the player, that is, the sounds delivered to the player from the conventional electronic piano differs from sounds produced by an acoustic piano.

This invention has been developed to provide a keyboard instrument capable of delivering, to a player, sounds having a sharp attack and an acoustic image whose location is clear.

The present invention provides a keyboard instrument including: an instrument body; at least one speaker; and at least one acoustic pipe configured to collect a sound emitted from the at least one speaker and guide the sound to at least one sound emitting opening formed in a front face of the instrument body.

BRIEF DESCRIPTION OF THE DRAWINGS

The objects, features, advantages, and technical and industrial significance of the present invention will be better understood by reading the following detailed description of the embodiments of the invention, when considered in connection with the accompanying drawings, in which.

DETAILED DESCRIPTION OF THE EMBODIMENTS

Figure 1:
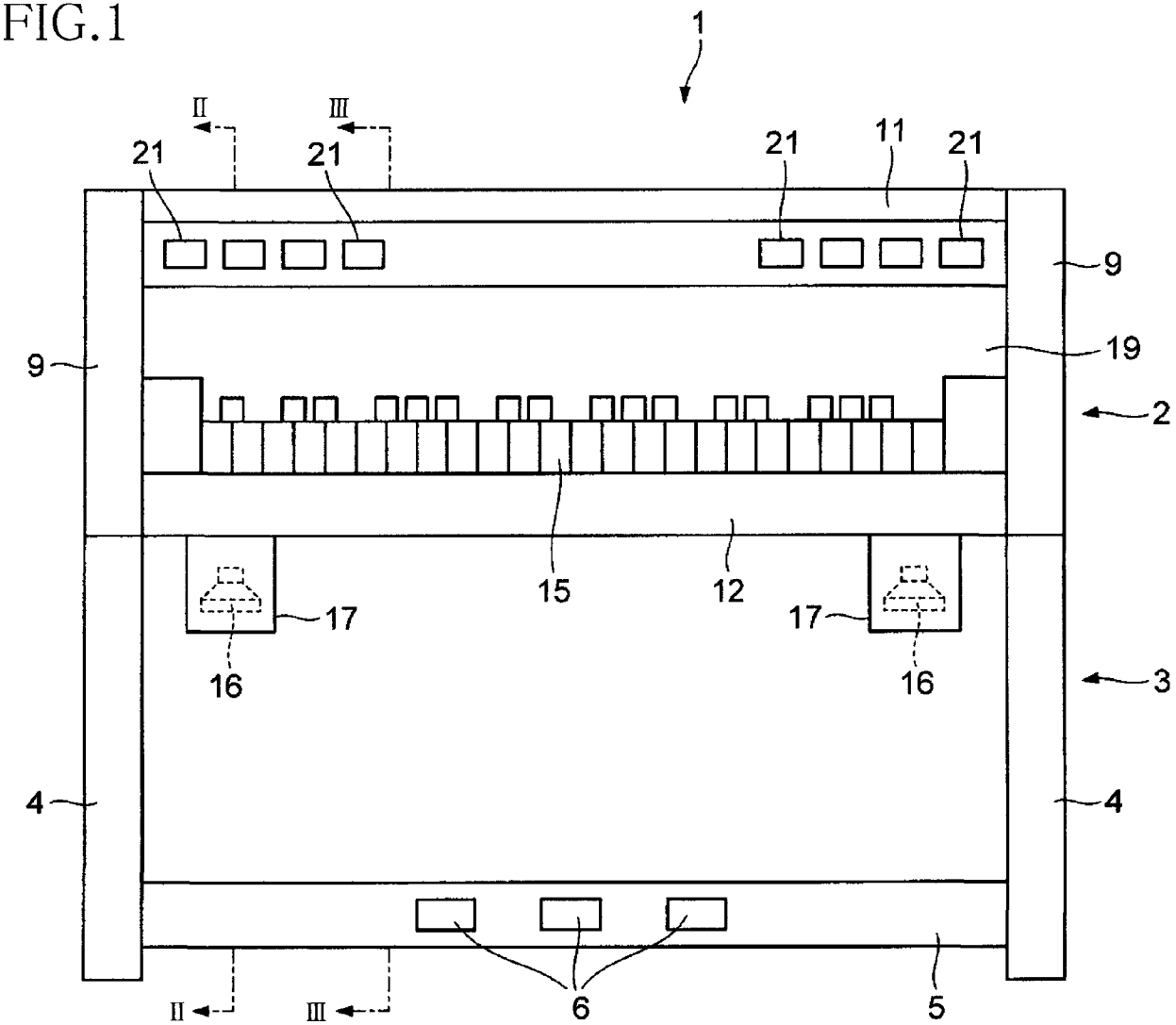
FIG. 1 is a front elevational view illustrating a structure of an electronic piano according to one embodiment of the present invention.
Figure 2:
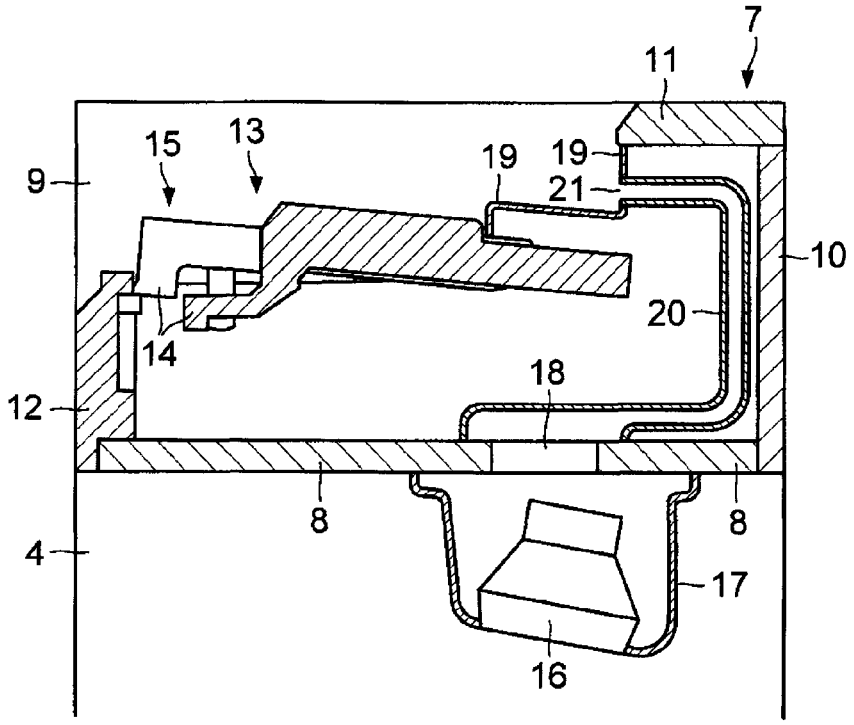
FIG. 2 is a cross-sectional view taken along line II-II in FIG. 1.
Figure 3:
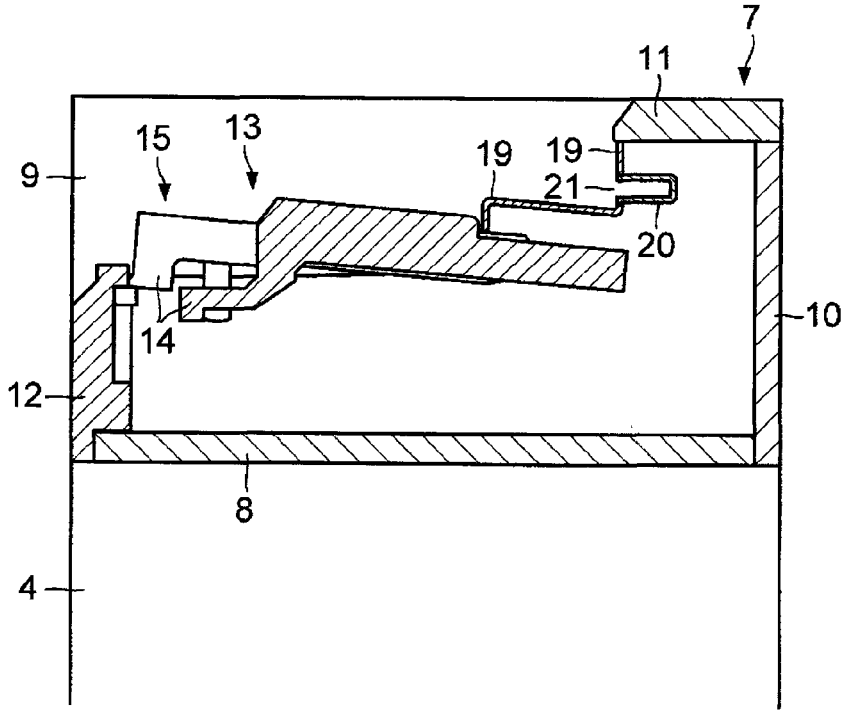
FIG. 3 is a cross-sectional view taken along line III-III in FIG. 1.

Hereinafter, there will be described embodiments of the present invention. FIG. 1 illustrates an electronic piano 1 according to one embodiment of the present invention. As illustrated in FIG. 1, this electronic piano 1 includes two-channel (right/left channel) speakers 16. FIG. 2 is a cross-sectional view of the electronic piano 1 illustrated in FIG. 1, taken along line II-II at which one of the speakers 16 is present. FIG. 3 is a cross-sectional view of the electronic piano 1 illustrated in FIG. 1, taken along line III-III at which the speakers 16 are absent.

As illustrated in FIG. 1, this electronic piano 1 includes a piano body 2 and a stand 3 supporting a lower side of this piano body 2. The stand 3 includes a pair of right and left legs 4 extending in an up and down direction and spaced apart from each other by a predetermined distance in a right and left direction. Lower end portions of the respective legs 4 are connected to each other by a pedal board 5 including three pedals 6.

As illustrated in FIG. 2, the piano body 2 includes an outer body casing 7. The body casing 7 includes, at its bottom portion, a horizontal rectangular keybed 8 (as one example of a support board). The body casing 7 further includes a pair of right and left side panels 9, a back board 10, a top panel 11, and a front board 12. These components and the keybed 8 form a box shape of the body casing 7.

A keyboard device 13 is placed on the keybed 8. The keyboard device 13 includes: a keyboard 15 (see FIG. 1) including a multiplicity of keys 14 arranged in the right and left direction; and a musical-sound producing device, not shown, configured to create two-channel (right/left channel) tone signals based on key-pressing information produced by playing of the keyboard 15 and then supply the created signals to the two-channel (right/left) speakers 16. While the electronic piano 1 includes the two speakers 16 in the present embodiment, the electronic piano 1 may include one or three or more speakers.

Two openings 18 (each as one example of a first opening) are respectively formed in right and left opposite portions of a rear portion of the keybed 8. Each of the two openings 18 has a predetermined diameter and is formed through the keybed 8 in the up and down direction. FIG. 2 illustrates a left one of the two openings 18. At positions under the keybed 8 and respectively opposite the openings 18, the two-channel (right/left) speakers 16 respectively supported by speaker holders 17 are placed, with a sound emitting face of each of the two-channel (right/left) speakers 16 facing downward (see FIG. 1). FIG. 2 illustrates the left-channel speaker 16 of the two speakers. Each of the speakers 16 is a full-range speaker capable of reproducing musical sounds within generally the whole audible frequency range of human hearing. The two-channel (right/left) speakers 16 are preferably inclined so as to face in a front and rear direction such that the sound emitting face, i.e., a front face of each of the speakers 16 faces in the downward direction and a direction toward a player. It is noted that the two-channel (right/left) speakers 16 may be inclined so as to also face in the right and left direction such that the sound emitting face of each of the speakers 16 faces toward a center of the electronic piano 1 in the right and left direction.

A front panel 19 is provided between the top panel 11 and the keyboard 15. This front panel 19 extends in the right and left direction between the right and left side panels 9 along the keyboard 15. As illustrated in FIG. 1, a plurality of rectangular sound emitting openings 21 are formed in the front panel 19 at its area just above the left-channel speaker 16 and its area just above the right-channel speaker 16.

In the present embodiment, an acoustic pipe 20 is provided in the body casing 7. As illustrated in FIG. 2, this acoustic pipe 20 is held in contact with the keybed 8 so as to cover, from above, the openings 18 formed in the right and left opposite portions of the keybed 8, and this acoustic pipe 20 communicates with the sound emitting openings 21. This acoustic pipe 20 guides sounds emitted from back faces of the respective speakers 16, to the sound emitting openings 21 formed in the front panel 19 (see FIG. 1), such that the emitted sounds do not spread to areas in the body casing 7 other than the sound emitting openings 21.

As illustrated in FIG. 3, the acoustic pipe 20 is not provided at an area in which the speakers 16 are not present under the keybed 8. This construction allows devices such as the musical-sound producing device to be provided using an area in which the acoustic pipe 20 is not provided.

Figure 4:
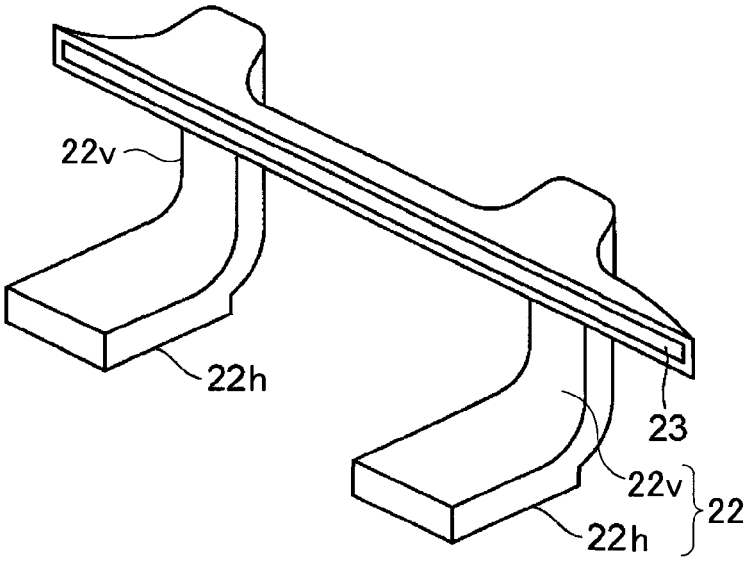
FIG. 4 is a perspective view illustrating a construction of an acoustic pipe in the embodiment.
Figure 5A:
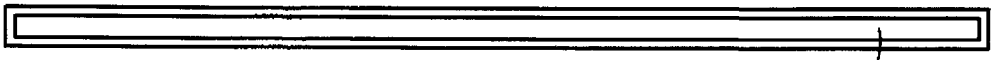
FIGS. 5A-5D are front elevational views illustrating other examples of sound emitting opening(s)
Figure 5B:
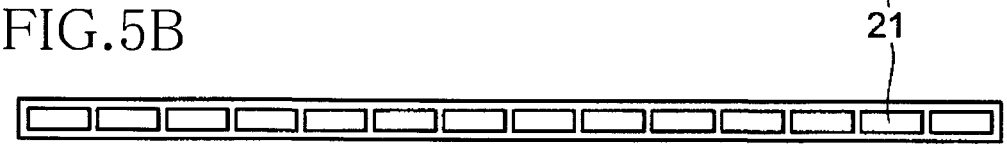
Figure 5C:
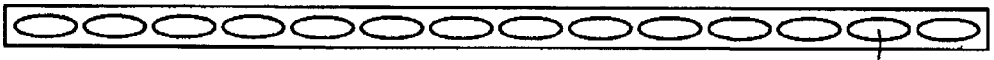
Figure 5D:
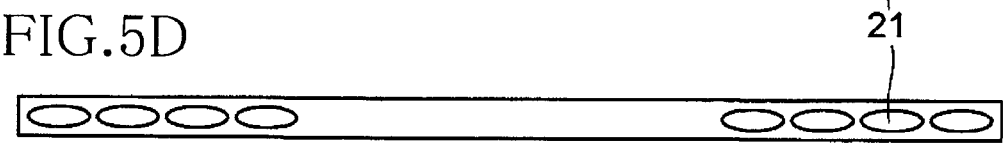

As illustrated in FIG. 4, the acoustic pipe 20 includes: two hollow sound collecting portions 22 spaced apart from each other in the right and left direction; and one hollow sound emitting portion 23 disposed on upper surfaces of the respective sound collecting portions 22 and extending in the right and left direction of the electronic piano 1. Here, a hollow area in each of the sound collecting portions 22 communicates with a hollow area in the sound emitting portion 23. Each of the two sound collecting portions 22 is constituted by a horizontal portion **22*h* and a vertical portion 22*v*. As illustrated in FIG. 2, a bottom surface of the horizontal portion 22*h* of each of the two sound collecting portions 22 has an opening (as one example of a second opening), and the openings formed in the respective horizontal portions 22*h* cover the respective right and left openings 18 formed in the keybed 8. A front portion of the sound emitting portion 23 has an opening extending over the entire width of the electronic piano 1 in the right and left direction, and a rear portion of the sound emitting portion 23 is connected to the vertical portions 22*v* of the respective two sound collecting portions 22 and thereby serves as a mixer configured to mix sounds guided through the vertical portions 22*v*. The cross-sectional area of the hollow area in the sound emitting portion 23 gradually increases from a portion of the hollow area which is connected to each of the vertical portions of the respective sound collecting portions 22, toward the front opening of the sound emitting portion 23. As illustrated in FIG. 2, a portion of the sound emitting portion 23 which defines the front opening is held in contact with the front panel 19. It is noted that the horizontal portions 22*h* guide sounds having entered from the openings of the respective two horizontal portions 22*h* into the acoustic pipe 20, in the rear direction, and the vertical portions 22*v* guide the sounds guided by the horizontal portions 22*h***, in the up direction.

In the construction as described above, the sounds emitted from the back faces of the respective right and left speakers 16 are guided into the sound emitting portion 23 via the horizontal portions **22*h* and the vertical portions 22*v* of the right and left sound collecting portions 22 and then emitted from the sound emitting portion 23 via the sound emitting openings 21 formed in the front panel 19**.

Also, the sounds having entered from the openings of the respective horizontal portions **22*h* into the acoustic pipe 20 travel upward through the respective vertical portions 22*v*, are mixed at the sound emitting portion 23 (as one example of the mixer), and are emitted from the sound emitting openings to an outside of the acoustic pipe 20**.

In the present embodiment as described above, the acoustic pipe 20 guides the sounds emitted from the speakers 16, to the sound emitting openings 21 formed in the front panel 19 of the body casing 7, such that the sounds do not spread to the areas in the body casing 7 other than the sound emitting openings 21. Accordingly, an amount of reduction in the volume of the sounds traveling to the player via the sound emitting openings 21 is less than that in the case of the conventional keyboard instrument, and a location of an acoustic image is determined near the keyboard, so that the sounds are clear with the localized acoustic image.

In the present embodiment, the sounds emitted from the back faces of the respective speakers 16 are introduced into the acoustic pipe 20 via the openings 18 of the keybed 8. This construction can reduce the length of a path extending from the speakers 16 to a player's ear via the acoustic pipe 20, allowing the player to easily hear high frequency components which are difficult to hear in the case of the sounds emitted from the sound emitting faces of the respective speakers 16. Accordingly, sounds having a sharp attack can be delivered to the player.

In the present embodiment, the acoustic pipe 20 extends over the entire width of the piano body 2 near the sound emitting openings 21. Accordingly, the player can hear high-quality sounds at any position in front of the instrument body.

Other Embodiments

While the embodiments of the present invention have been described above, it is to be understood that the invention is not limited to the details of the illustrated embodiments, but may be embodied with various changes and modifications, which may occur to those skilled in the art, without departing from the spirit and scope of the invention.

(1) FIGS. 5A-5D illustrate various examples of the sound emitting opening(s) 21 formed in the front panel 19. In the example illustrated in FIG. 5A, a sound emitting opening 21 extend over the entire front panel 19 in the right and left direction. In the examples illustrated in FIGS. 5B and 5C, a plurality of rectangular or oval sound emitting openings 21 are arranged uniformly spaced apart from each other over the entire front panel 19 in the right and left direction. In the example illustrated in FIG. 5D, a plurality of oval sound emitting openings 21 are arranged uniformly spaced apart from each other at only two areas located just above the respective right and left speakers 16. The shape and arrangement of the sound emitting openings 21 may be changed according to, e.g., an overall design of the electronic piano 1 and preferences on sound quality.

Though not illustrated, a collection of fine openings may be formed in the front panel 19 as the sound emitting openings 21 in the form of a mesh having rectangular or oval openings in its entirety. Alternatively, instead of the mesh form of the sound emitting openings 21, a cover may be provided for covering the sound emitting openings 21, and this cover may be opened so as to expose the sound emitting openings 21 to the outside only when the electronic piano 1 is used. These constructions can prevent ingress of undesired materials such as dust from the sound emitting openings 21 into the acoustic pipe 20.

Though not illustrated, the sound emitting openings 21 may be formed in a side face, a rear face, or an upper face of the piano body 2 instead of the front face of the piano body 2. The sound emitting openings 21 may be formed in a plurality of faces of the piano body 2 other than its front face. The sound emitting openings 21 may be formed in the front face of the piano body 2 and a plurality of faces of the piano body 2 other than its front face. In the construction in which the sound emitting openings 21 are formed in the front face of the piano body 2 and a plurality of faces of the piano body 2 other than its front face, the acoustic pipe 20 may branch off so as to extend to the front face and other surfaces of the piano body 2. In this construction, the user can hear both of sounds having a sharp attack which are emitted from the front face of the piano body 2 and sounds spreading better which are emitted from faces of the piano body 2 other than the front face such as the rear face.

(2) The acoustic pipe 20 may have various constructions. FIGS. 6-12 illustrate various examples of the acoustic pipe 20. In an acoustic pipe 20A illustrated in FIG. 6, a sound emitting portion 23A has a rectangular parallelepiped shape and occupies an area between the front panel 19 and the back board 10 over the entire width of the electronic piano 1 in the right and left direction. Right and left vertical portions 22Av of a sound collecting portion 22A are connected to a bottom surface of the sound emitting portion 23A (as one example of the mixer).

Figure 6:
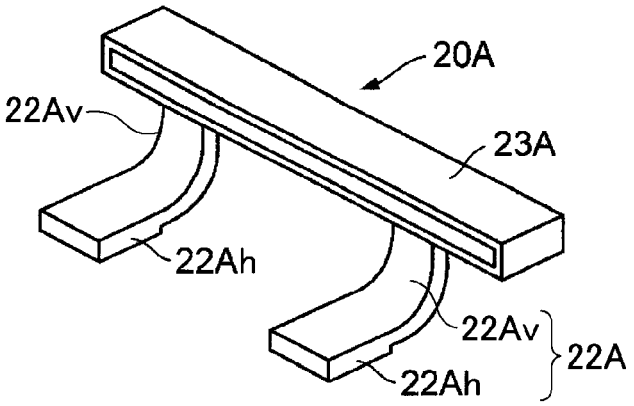
FIG. 6 is a perspective view illustrating another example of the acoustic pipe.
Figure 7:
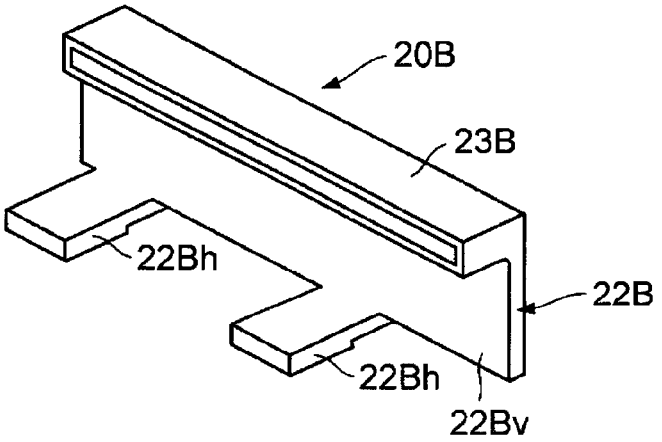
FIG. 7 is a perspective view illustrating another example of the acoustic pipe.

In an acoustic pipe 20B illustrated in FIG. 7, a sound emitting portion 23B is similar in construction to the sound emitting portion 23A illustrated in FIG. 6. The sound collecting portion 22B includes: two horizontal portions 22Bh each for collecting sounds emitted from the two-channel (right/left channel) speakers 16; and a vertical portion 22Bv (as one example of the mixer) shared by the two horizontal portions 22Bh and extending over the entire width of the electronic piano 1 in the right and left direction. Here, hollow areas formed respectively in the two horizontal portions 22Bh, the vertical portion 22Bv, and the sound emitting portion 23B (as one example of the mixer) communicate with each other.

Figure 8:
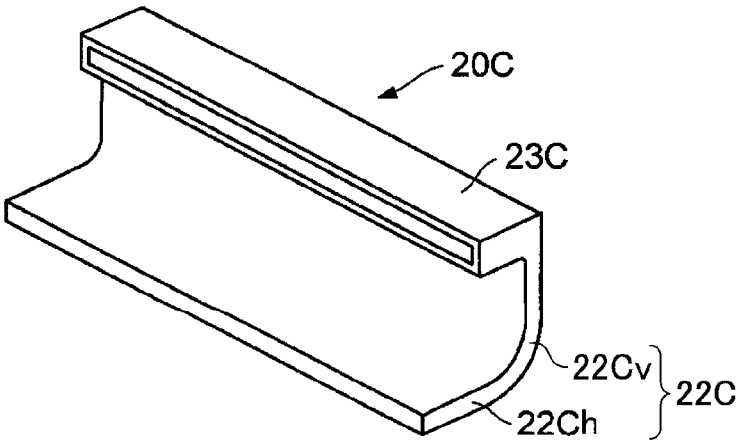
FIG. 8 is a perspective view illustrating another example of the acoustic pipe.

An acoustic pipe 20C illustrated in FIG. 8 includes a sound collecting portion 22C and a sound emitting portion 23C formed integrally with each other and each extending over the entire width of the electronic piano 1 in the right and left direction. The sound collecting portion 22C includes a horizontal portion 22Ch and a vertical portion 22Cv. A lower surface of the horizontal portion 22Ch of the sound collecting portion 22C has two openings for receiving the sounds emitted from the respective two-channel (right/left channel) speakers 16.

Figure 9:
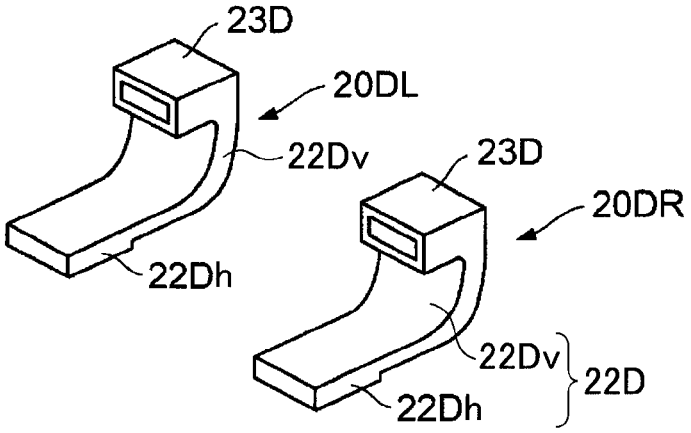
FIG. 9 is a perspective view illustrating another example of the acoustic pipe.

In the example illustrated in FIG. 9, the acoustic pipe is separated into two acoustic pipes, namely, an acoustic pipe 20DL for guiding sounds emitted from the left-channel speakers 16, to the sound emitting openings 21 formed in the front panel 19, and an acoustic pipe 20DR for guiding sounds emitted from the right-channel speakers 16, to the sound emitting openings 21 formed in the front panel 19. Each of the acoustic pipes 20DL, 20DR includes: a sound collecting portion 22D whose lower surface has an opening for receiving sounds emitted from the back faces of the respective speakers 16; and a sound emitting portion 23D for guiding the sounds guided via the sound collecting portion 22D, to the sound emitting openings 21 formed in the front panel 19. The sound collecting portion 22D includes a horizontal portion 22Dh and a vertical portion 22Dv.

Figure 10:
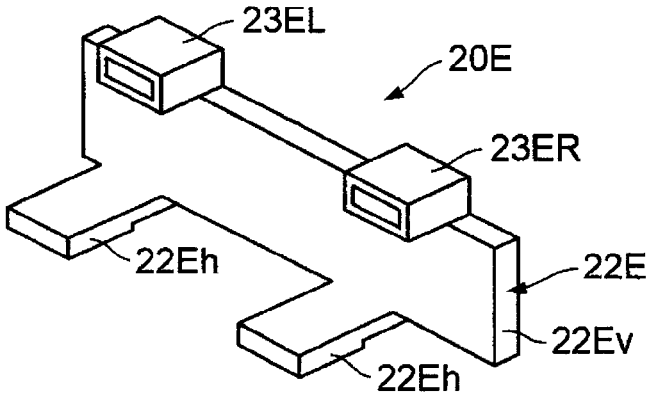
FIG. 10 is a perspective view illustrating another example of the acoustic pipe.

In an acoustic pipe 20E illustrated in FIG. 10, a sound collecting portion 22E including two horizontal portions 22Eh and a shared vertical portion 22Ev (as one example of the mixer) is similar in construction to the sound collecting portion 22B illustrated in FIG. 7. In the acoustic pipe 20E illustrated in FIG. 10, the sound emitting portion 23 is separated into a sound emitting portions 23EL for the left channel and a sound emitting portion 23ER for the right channel.

Figure 11:
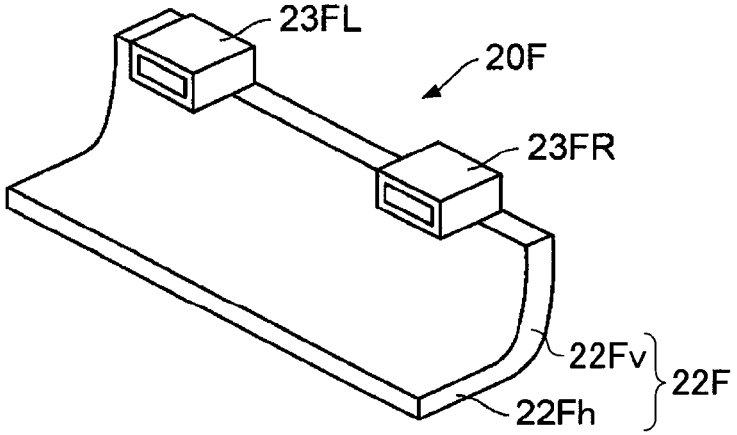
FIG. 11 is a perspective view illustrating another example of the acoustic pipe.

In an acoustic pipe 20F illustrated in FIG. 11, the sound emitting portion 23C of the acoustic pipe 20C illustrated in FIG. 8 is separated into a sound emitting portion 23FL for the left channel and a sound emitting portion 23FR for the right channel. A sound collecting portion 22F for both of the right and left channels includes a horizontal portion 22Fh and a vertical portion 22Fv.

Figure 12:
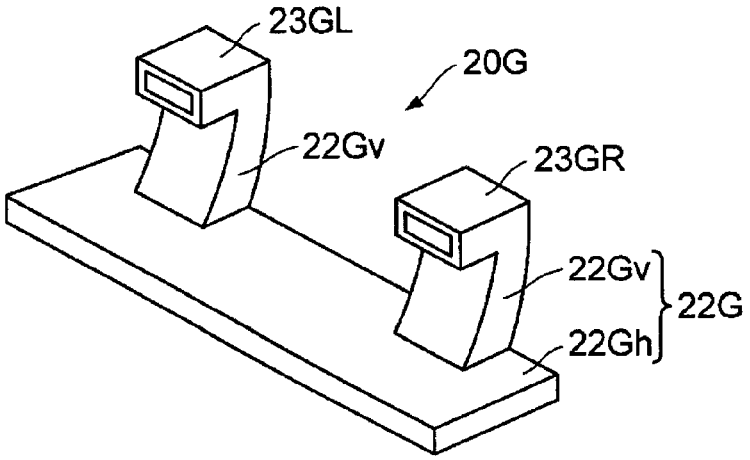
FIG. 12 is a perspective view illustrating another example of the acoustic pipe.

In an acoustic pipe 20G illustrated in FIG. 12, a sound collecting portion 22G includes a horizontal portion 22Gh for both of the right and left channels and two vertical portions 22Gv respectively for the right and left channels. A left-channel sound emitting portion 23GL and a right-channel sound emitting portion 23GR are respectively connected to the vertical portions 22Gv for the left channel and the vertical portions 22Gv for the right channel.

One of the embodiments of the acoustic pipe 20 described above may be selected based on sound quality and a layout of the musical-sound producing device and so on in the body casing 7, for example.

While the acoustic pipe 20 is constituted by the sound collecting portion 22 and the sound emitting portion(s) 23 in the above-described embodiments, the back board 10 and/or the top panel 11 may be used for a portion of a wall surface for surrounding the sound emitting portion(s) 23.

Figure 13:
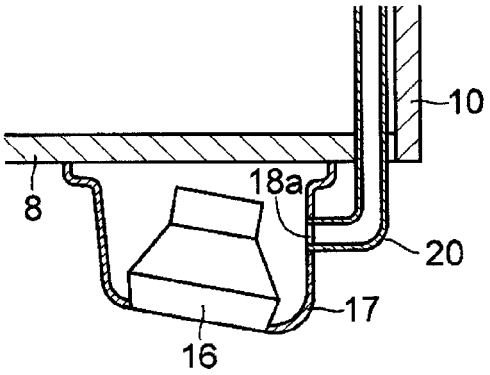
FIG. 13 is a cross-sectional view illustrating another example of a construction for introducing sounds from a speaker into the acoustic pipe.

(3) In the above-described embodiments, the keybed 8 has the openings 18 via which the sounds emitted from the speakers 16 are introduced into the acoustic pipe 20. However, various constructions may be employed for introducing sounds from the speakers 16 into the acoustic pipe 20. FIG. 13 illustrates an alternative embodiment with a modified construction for introducing sounds into the acoustic pipe 20. In the embodiment illustrated in FIG. 13, the keybed 8 does not have the openings 18, and openings 18*a* are formed in a side wall of the speaker holder 17. The acoustic pipe 20 extends through the keybed 8 and communicates with the openings 18*a* formed in the speaker holder 17. The sounds emitted from the back faces of the respective speakers 16 are introduced from the openings 18*a* of the speaker holder 17 into the acoustic pipe 20 and then guided to the sound emitting openings 21 formed in the front panel 19.

Figure 14:
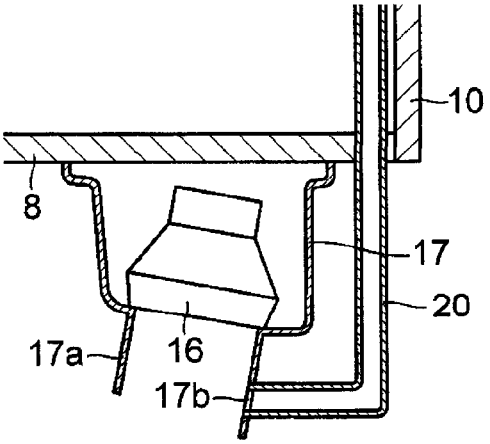
FIG. 14 is a cross-sectional view illustrating another example of the construction for introducing sounds from the speaker into the acoustic pipe.

Also, while the sounds emitted from the back faces of the respective speakers 16 are guided by the acoustic pipe 20 in the above-described embodiments, the sounds emitted from the sound emitting faces of the respective speakers 16 may be guided by the acoustic pipe 20 into the sound emitting openings 21 formed in the front panel 19. FIG. 14 illustrates an alternative embodiment in which the keybed 8 does not have the openings 18. A hollow cylindrical member 17*a* having opposite open ends is fixed to a lower surface of the speaker holder 17. This hollow cylindrical member 17*a* guides the sounds emitted from the sound emitting faces of the respective speakers 16, in an obliquely down direction, i.e., a direction inclined toward the player. The acoustic pipe 20 communicates with an opening 17*b* formed in the hollow cylindrical member 17*a*. In this embodiment, the sounds emitted from the sound emitting faces of the respective speakers 16 are guided by the acoustic pipe 20 to the sound emitting openings 21 formed in the front panel 19. This embodiment also achieves the same effects as achieved in the above-described embodiments.

(4) While the speakers 16 are fixed using the speaker holder 17 in the above-described embodiments, the speakers 16 may be mounted directly on the keybed 8 without using the speaker holder 17. Though not illustrated, for example, the openings 18 are formed in the keybed 8, the back faces of the respective speakers 16 are inserted into the respective openings 18 to mount the speakers 16 directly on the keybed 8, and the acoustic pipe 20 covers, from above, the back faces of the respective speakers 16 which are exposed from the respective openings 18 of the keybed 8. Also in this construction, the sounds emitted from the back faces of the respective speakers 16 can be guided by the acoustic pipe 20 to the sound emitting openings 21 formed in the front panel 19.

(5) While the present invention is applied to the electronic piano in the above-described embodiments, the present invention is applicable to any keyboard instrument other than the electronic piano such as a synthesizer and an electric organ as long as the keyboard instrument includes a speaker.

What is claimed is:

1. A keyboard instrument comprising:

an instrument body having a front face and at least one sound emitting opening disposed in the front face;

a keyboard extending horizontally;

at least one speaker; and at least one acoustic pipe configured to collect a sound emitted from the at least one speaker and guide the sound to the at least one sound emitting opening, wherein the at least one acoustic pipe includes:

a vertical portion extending vertically from a rear of the keyboard, with a lower end thereof positioned below the keyboard and an upper end thereof positioned above the keyboard; and a first horizontal portion extending from the upper end of the vertical portion, wherein the vertical portion is configured to guide the sound emitting from the at least one speaker to the first horizontal portion, and wherein the first horizontal portion is configured to guide the sound to the at least one sound emitting opening.

2. The keyboard instrument according to claim 1, wherein:

the at least one speaker has a first face that directly emits a sound outside of the instrument body and a second face that is different from the first face, and the at least one acoustic pipe is configured to guide the sound emitting from the second face of the at least one speaker to the at least one sound emitting opening.

3. The keyboard instrument according to claim 2, further comprising:

at least one speaker holder, wherein the instrument body includes a support board extending horizontally, wherein the at least one speaker holder is fixed to a lower surface of the support board, wherein the at least one speaker holder holds the at least one speaker, wherein the support board has at least one opening facing the second face of the at least one speaker, and wherein the at least one acoustic pipe is configured to guide the sound exiting through the at least one opening to the at least one sound emitting opening.

4. The keyboard instrument according to claim 1, wherein the at least one acoustic pipe further includes at least one sound collecting portion configured to collect the sound emitted from the at least one speaker.

5. The keyboard instrument according to claim 4, wherein the at least one sound collecting portion comprises:

at least one second horizontal portion each having a first opening opposed to the at least one speaker and connected to the lower end of the vertical portion, each of the at least one second horizontal portion being configured to guide the sound entering from the first opening into the vertical portion of the at least one acoustic pipe, wherein the vertical portion extends upwardly from the at least one second horizontal portion and is configured to guide the sound to the first horizontal portion.

6. The keyboard instrument according to claim 5, wherein:

the at least one speaker comprises a plurality of speakers arranged spaced apart from each other horizontally, and the at least one second horizontal portion comprises a plurality of second horizontal portions arranged spaced from each other horizontally and respectively opposed to the plurality of speakers.

7. The keyboard instrument according to claim 6, wherein the at least one sound collecting portion includes a mixer configured to mix sounds entering from the respective first openings of the plurality of horizontal portions into the at least one acoustic pipe.

8. The keyboard instrument according to claim 7, wherein the vertical portion is configured to mix the sounds from the plurality of second horizontal portions and functions as the mixer.

9. The keyboard instrument according to claim 7, wherein:

the vertical portion comprises a plurality of vertical portions each extending upwardly respectively from the plurality of second horizontal portions, and the mixer is configured to mix sounds guided upward by the plurality of vertical portions.

10. The keyboard instrument according to claim 4, wherein a cross-sectional area of the at least one acoustic pipe increases from the at least one sound collecting portion toward the at least one sound emitting opening.

11. The keyboard instrument according to claim 4, wherein:

the at least one speaker comprises a plurality of speakers arranged spaced apart from each other horizontally, the at least one sound collecting portion comprises a plurality of sound collecting portions respectively corresponding to the plurality of speakers and arranged spaced apart from each other horizontally, and the at least one sound emitting opening is configured to mix sounds guided by the plurality of sound collecting portions.

12. The keyboard instrument according to claim 1, wherein the at least one sound emitting opening comprises a plurality of sound emitting openings disposed in the front face of the instrument body and arranged horizontally.

13. The keyboard instrument according to claim 3, wherein:

the at least one speaker comprises a first speaker and a second speaker horizontally spaced from the first speaker, the at least one speaker holder comprises a first speaker holder holding the first speaker and a second speaker holder holding the second speaker, the at least one opening comprises a first opening facing the second face of the first speaker and a second opening facing the second face of the second speaker, the at least one acoustic pipe further includes second and third horizontal portions each having a third opening opposing one of the first or second speakers through one of the first or second opening and connected to the lower end of the vertical portion, each of the second and third horizontal portions being configured to guide the sound entering from the respective third opening into the vertical portion of the at least one acoustic pipe, wherein the vertical portion extends upwardly from the second and third horizontal portions and is configured to guide the sound to the first horizontal portion.

* * * * *